United States Patent [19]

Mirahem

[11] Patent Number: 4,805,328

[45] Date of Patent: Feb. 21, 1989

[54] TALKING DOLL

[75] Inventor: William C. Mirahem, Reseda, Calif.

[73] Assignee: Marantz Company, Chatsworth, Calif.

[21] Appl. No.: 912,781

[22] Filed: Sep. 29, 1986

[51] Int. Cl.[4] ..... G09F 27/00

[52] U.S. Cl. ..... 40/457; 40/416; 40/466; 446/301; 446/298

[58] Field of Search ..... 40/457, 416, 463, 414, 40/466; 446/299, 301, 298, 302, 303

[56] References Cited

U.S. PATENT DOCUMENTS

| | | | |
|---|---|---|---|
| 2,247,329 | 6/1941 | Deitz | 446/303 X |
| 2,270,142 | 1/1942 | Robinson et al. | 446/303 X |
| 2,603,912 | 7/1952 | Gruber | 446/302 X |
| 2,871,593 | 2/1959 | Roberts | 40/457 |
| 3,131,497 | 5/1964 | Rogers | 40/457 |
| 3,230,664 | 1/1966 | Bornn et al. | 446/299 |
| 3,230,665 | 1/1966 | Ryan | 446/299 |
| 3,246,409 | 4/1966 | Taylor et al. | 40/457 |
| 3,261,124 | 7/1966 | Bodenstein | 446/299 |
| 3,277,594 | 10/1966 | Rogers et al. | 40/457 |
| 3,292,610 | 12/1966 | Newman | 128/1 C |
| 3,293,794 | 12/1966 | Ryan | 446/299 |
| 3,293,795 | 12/1966 | Ryan | 446/299 |
| 3,298,130 | 1/1967 | Ryan | 446/299 |
| 3,315,406 | 4/1967 | Ryan | 446/299 |
| 3,364,382 | 1/1968 | Harrison, III | 340/725 |
| 3,421,254 | 1/1969 | Ryan et al. | 446/299 |
| 3,473,260 | 10/1969 | Kripak et al. | 446/191 |
| 3,583,093 | 6/1971 | Glass | 446/299 |
| 3,662,374 | 5/1972 | Harrison, III et al. | 340/725 |
| 3,828,469 | 8/1974 | Giroud | 446/337 |
| 3,881,275 | 5/1975 | Baulard-Cogan | 446/351 |
| 3,912,694 | 10/1975 | Chiappe et al. | 360/79 |
| 4,027,425 | 6/1977 | Morrison et al. | 446/299 |
| 4,107,462 | 8/1978 | Asija | 381/110 |
| 4,139,968 | 2/1979 | Milner | 446/301 |
| 4,177,589 | 12/1979 | Villa | 40/457 |
| 4,207,704 | 6/1980 | Akiyama | 446/301 |
| 4,294,033 | 10/1981 | Terzian | 446/190 |
| 4,484,408 | 11/1984 | Fogarty et al. | 446/299 |
| 4,579,540 | 4/1986 | Ho | 446/301 |

*Primary Examiner*—Gene Mancene
*Assistant Examiner*—J. Hakomaki
*Attorney, Agent, or Firm*—Fulwider, Patton, Rieber, Lee & Utecht

[57] ABSTRACT

A means of animating the features of a doll or mannequin responsive to an audio signal. The invention utilizes an open loop electromechanical drive mechanism that is actuated by electronic drive signals derived from an audio signal. The electronic drive signals are of a simplified on-off characteristic based upon thresholding of the audio signal. When combined with the spring rate and drive ratio of the mechanism and the electrical characteristics of the motor, realistic animation of speech or other movements is created.

17 Claims, 5 Drawing Sheets

TALKING DOLL

BACKGROUND OF THE INVENTION

Lifelike animation of mannequins and dolls has long been a goal of the toy and entertainment industry. From the earliest "mama" type of doll to the most sophisticated human simulations generated for amusement park use, such animations have taken many forms and have enjoyed wide use and popularity as both toys and displays in amusement parks. The common goal in all of these animations has been the accurate simulation of speech, especially in terms of the synchronization of the facial features of the mannequin with an audio signal containing vocalization of both words and music. Such animation schemes have usually taken the form of electro-mechanical or pneumo-mechanical mechanisms which operate facial features via linkages connected to solenoids or motors. The solenoids and motors are typically driven by signals generated to operate in synchronization with the audio or are derived from the audio signal by electronic circuits sensing certain frequency spectra or other characteristic audio signals.

While the more complex of these schemes have been highly successful in the generation of animation which closely emulates the human features during speech or singing, they have also been technically complex and expensive to construct and maintain. This has prevented their utilization in the mass market for toys and the such and has restricted their use to expensive displays in amusement parks. There has been a continuing requirement for effective simulation of speech in toys which are available in the mass market, especially those that are capable of story telling or other interactive activity with the child. However, such systems have suffered from either, on the one hand, inaccurate emulation of speech animation due to their simplicity and the inexpensiveness of their construction or, on the other hand, excessive cost and complexity while providing an improved speech emulation. Therefore, there is a continuing need for a simple, inexpensive to construct and accurate speech emulation mechanism for use in toys and other inexpensive mannequins for the mass market.

SUMMARY OF THE INVENTION

The present invention is a novel electro-mechanical system providing realistic and accurate emulation of speech in a mannequin by the use of digital drive signals derived from unmodified audio signals available from any of a number of conventional electronic sources. The system provides these advantages while avoiding unnecessary mechanical and electronic complexity, thereby providing an economic and accurate means of animating a doll or other mannequin for the mass market. The invention utilizes an electric motor that drives a mechanism incorporating a spring and lever means connected to the features to be animated. The motor is driven by digital signals derived by a simple circuit from an electric recording of an audio input. The frequency and power density of the signals is altered in consonance with the signals derived from the audio, and when combined with the spring and damping characteristics of the drive mechanism, realistic speech emulations are produced.

Previous systems to perform the movement of facial features in a mannequin relied upon direct linkages between the actuators, whether solenoids or motors, and the features being animated. In the more complex systems, a closed loop control system was used to command instantaneous positions of the features via a servomechanism. In the simpler systems, a mere on/off signal was given and the mechanism operated the features to one or more of the positions equivalent to those commands. The present invention avoids, on the one hand, the complexity of closed-loop servomechanisms systems and, on the other hand, the unrealistic animation associated with the solenoid or motor-type open-loop systems.

The basic structure of the invention incorporates a feature to be animated, a mechanism to move the feature, a motor subsystem to drive the mechanism, and an electronic subsystem to generate signals to drive the motor subsystem based upon audio signals. The structure of the feature to be animated and the mechanical mechanism to drive it may take many forms as required to adapt the remainder of the invention to the specific application. The motor drive mechanism makes use of a novel, simple, inexpensive and easily fabricated construction that the inventor has found provides remarkably lifelike movements without the complication of closed loop servomechanisms. The motor drive mechanism uses, in combination, a motor with a constant air gap and circular magnetic structure, a spring mechanism to provide a torque in opposition to the drive force of the motor and a gear or other mechanical drive connection to turn the rotational motion of the motor into the desired action of the features being animated.

In operation, the motor is driven "open-loop" by on-off signals of variable duration and constant amplitude. When the signal is on, the motor drives the mechanism against the spring force operating on the mechanism. When the signal is off, the spring operates to return the mechanism to its rest position and the motor provides electromagnetic damping force to slow the return of the mechanism. Thus the position assumed by the mechanism is controlled by the duty cycle of the on-off signal applied to the motor, the spring constant and damping of the motor and the geometry of the mechanism and drive train.

The signal to drive the motor is derived from a conventional audio signal and is converted to an on-off signal of constant maximum voltage. While it is possible to drive the motor directly by the audio signal, this requires a higher power audio amplifier to drive the motor. This form of the invention is, therefore, more useful for accurate, but relatively more expensive animations. However, a simpler version of the above system has proven to create realistic and acceptable animations when converted to a simple on-off signal by a relatively inexpensive and simple threshhold sensing and switching circuit, thereby avoiding the audio amplifier. For either drive voltage scheme or variation thereof, appropriate choices of spring rate and drive mechanism geometry must be made to insure realistic animation.

An important feature of the motor drive signal generator is the fact that the complexities associated with frequency spectrum analysis and other audio signal analysis used by more complex systems to derive feature movement signals is avoided, thereby substantially approving the simplicity of the system and lowering its cost. Also, actual mouth movements associated with speech are relatively subtle; in talking toys, it is desirable to exaggerate the mouth movements produced in order to create a more pleasing effect in the animation of the doll.

The motor that is used in the present invention differs from those commonly described or used in the prior art in the following important ways. The prior art motors use a construction with two or more magnet structures disposed on the periphery, thereby producing an uneven braking torque as the rotor is rotated about the centerline of the axis. In the present invention, the advantages associated with a less common type of motor are integrated into the design of the mechanism, the motor having a ring magnet with a constant air gap disposed around the periphery. The gap spaces between the poles of the ring magnet are kept small. Thus, the torque seen at the drive gear due to damping when the power is removed from the motor is essentially linear with rotation angle, thereby producing a smoother damping force. This characteristic is important in the present invention since any uneven damping in the motor will produce an uneven motion in the feature being animated, thereby degrading the realism of the animation. It is conceivable that motors that display an uneven torque as a function of shaft rotation angle may be used, provided that the linkage or gear ratio is sufficiently high as, for example, if a planetary gear set were used, that such unevenness is masked at the feature being actuated. However, for most applications the use of a constant braking torque motor is more economical and easily implemented.

In dolls of the type associated with the present invention, it is often desirable to produce animations that are not necessarily realistic but which are pleasing to the beholder. Such animations may be produced by the structure of the present invention as exemplified by the following example. For instance, the eyes of the doll may be lighted by internal lights, as for example, light emitting diodes (LED) which are turned on by signals gated from the audio circuit described above and controlled by a sub or supersonic signal superimposed on the audio tape, thereby avoiding the continuous and distracting animation of the eye lighting mechanism. Numerous other features of animation could be driven in the same way, all without resorting to complex electronic circuits or other complications to the relatively simple, reliable and inexpensive mechanism or system described in the present invention.

Other features and advantages of the present invention will become apparent from the following detailed description taken in conjunction with the accompanying drawing, which illustrate, by way of example, the principles of the invention.

DETAILED DESCRIPTION OF THE INVENTION

As shown in the exemplary drawings, the present invention is embodied in a unique combination of electronics and electro-mechanical drive mechanism that effectively animates the features of a mannequin while avoiding the necessity for closed loop servo mechanisms and complex electronics. Previous inventions designed to animate mannequins, and especially those designed to emulate speech, have either been unrealistic in that the motions imparted to the mannequin were discontinuous or otherwise not pleasing or, if realistic, were produced by complex, closed-loop servo mechanisms and relatively sophisticated electronic circuits designed to derive signals to drive the servo mechanism based upon sensing of certain electromagnetic spectra in the audio signal. The present invention provides the accurate emulation of features of a mannequin and especially the emulation of speech by a unique combination of an open loop electromechanical mechanism and a simplified electronic circuit that derives signals to drive the electromechanical servo from conventional audio signals. The invention utilizes a motor with low back torque that presents a constant braking torque as a function of shaft rotation when the stator is not energized. When actuated, the motor operates against a spring that urges the mechanism to its rest position, thereby moving the features to its open position. When the actuating signal is removed from the motor, the spring operates to urge the motor to the rest position against the braking torque of the motor. The electronics provides a drive signal to the motor output in the form of on-off signals of a constant voltage whose period and timing are determined by the period and time in which the audio signal reaches a certain threshhold. These signals drive the motor as described above, the combination of motor drive and mechanism effectively simulating the animation of features appropriate to speech by the mannequin.

Figure 1:
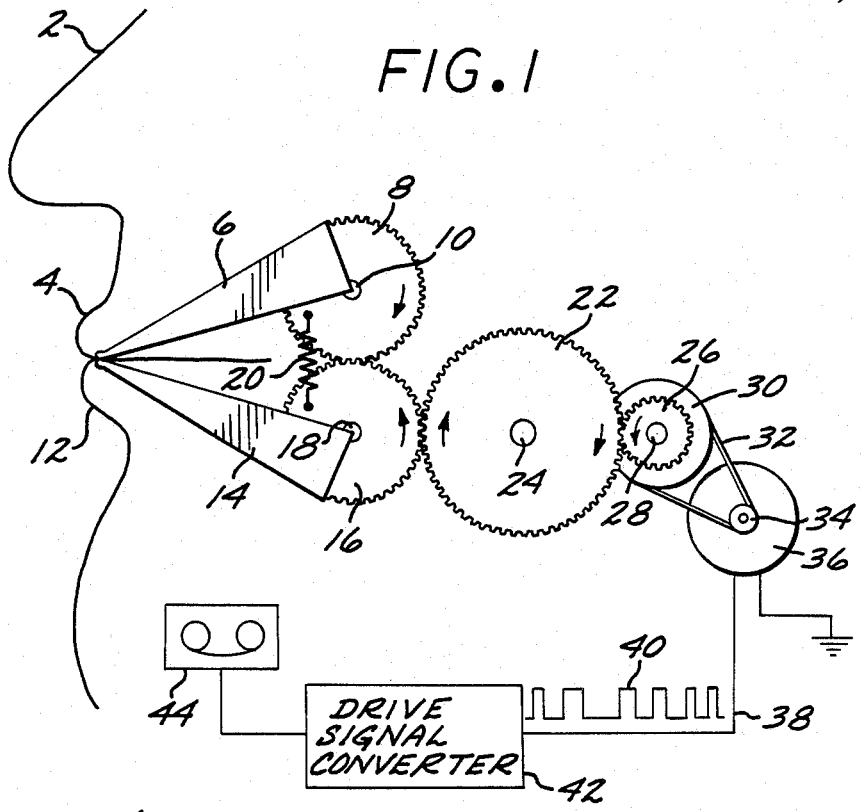
FIG. 1 is a cross-section of a mannequin showing animation of the mouth embodying the present invention and a schematic of the electronic signal drive mechanism.

Referring to FIG. 1, a cross-section of a mannequin incorporating the mechanism of the present invention is illustrated. The upper lip 4 of mannequin 2 is operated by structure 6 which is fastened to gear 8 rotating on shaft 10. Likewise, the bottom lip 12 is actuated by structure 14 attached to gear 16 rotating about shaft 18, both shafts 10 and 18 being located in the structure of the mannequin 2 so as to provide constant mesh between gear 8 and gear 16. Spring 20 is mounted to urge gears 8 and 16 in the direction to close lips 4 and 12 to their rest positions. Gears 8 and 16 are driven in turn by gear 22 mounted on shaft 24 and gear 26 mounted on shaft 28 and being driven in turn by pulley 30 attached to gear 26 and concentric therewith. Pulley 30 is driven by belt 32 operated by pulley 34 attached to the shaft of motor 36. Motor 36 is driven by an on-off electrical signal appearing on line 38 as represented by the graphic 40 of the signal generated by the drive signal converter 42 responsive to audio signals input from audio tape player 44. The configuration of the drive train of the present invention as exemplified by FIG. 1 must be considered as a system in which the characteristics of the gear train, spring 20 and motor 36 all are chosen to operate in a compatible manner with the signal generated by drive signal converter 42 in order to produce realistic simulations.

Figure 2:
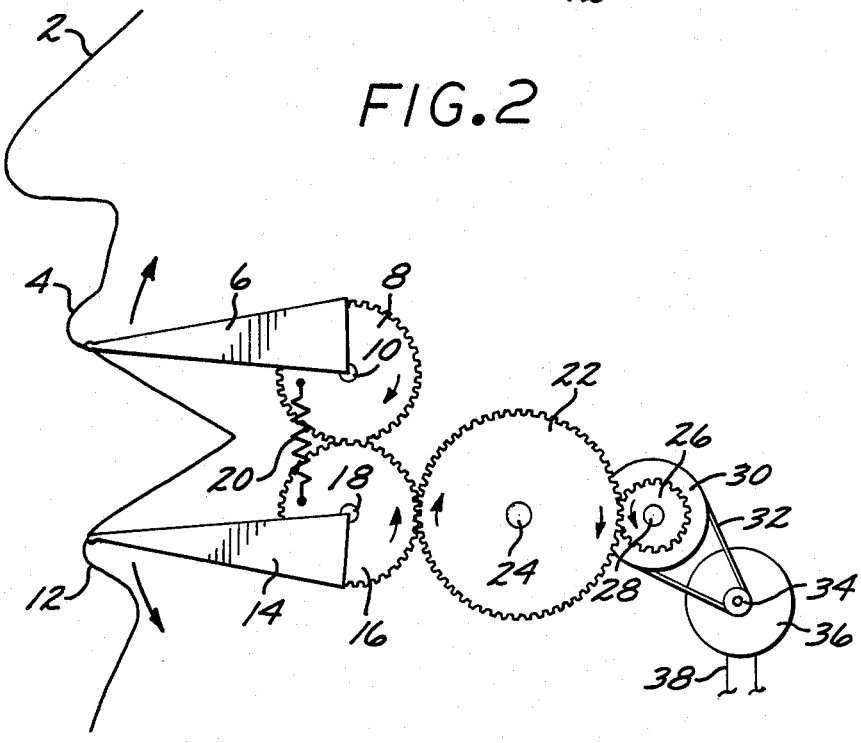
FIG. 2 is a cross-section similar to FIG. 1 showing the mouth opened by the drive system of the present invention.

FIG. 2 illustrates a similar cross-section of the mannequin incorporating the present invention with the lips 4 and 12 in the fully open position, thereby extending spring 20 to the open position desired when motor 36 is driven by the maximum duty cycle generated by drive signal converter 42 and appearing on line 38. As discussed above, the characteristics of each component of the invention must be carefully chosen to provide the motions desired for the audio signal used.

Figure 3:
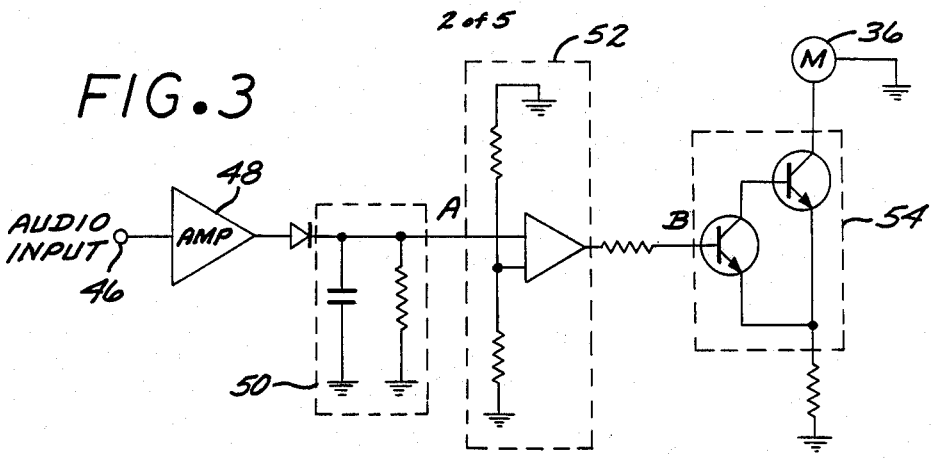
FIG. 3 is a schematic of the electronic circuit to convert an audio input into the drive signals for the motor of the present invention.

FIG. 3 is a schematic of drive signal converter 42 that generates the signal to drive motor 36. In practice, an audio input appears at 46 and is amplified by amplifier 48 before passing through integrator 50 and threshhold detector 52. Thereafter, the on-off signal that is the result of the integrator 50 and threshhold sensor 52 is produced at B for amplification in amplifier 54 to drive motor 36. While the concept behind the drive signal converter 42 is relatively simple, many parameters may be varied in the conversion process to produce approriate drive signals for the motor. In practice, it has been found that fine tuning of the response of the invention to audio signals is easily accomplished by altering the parameters of the electronic circuits used to generate the motor drive signals.

Figure 4:
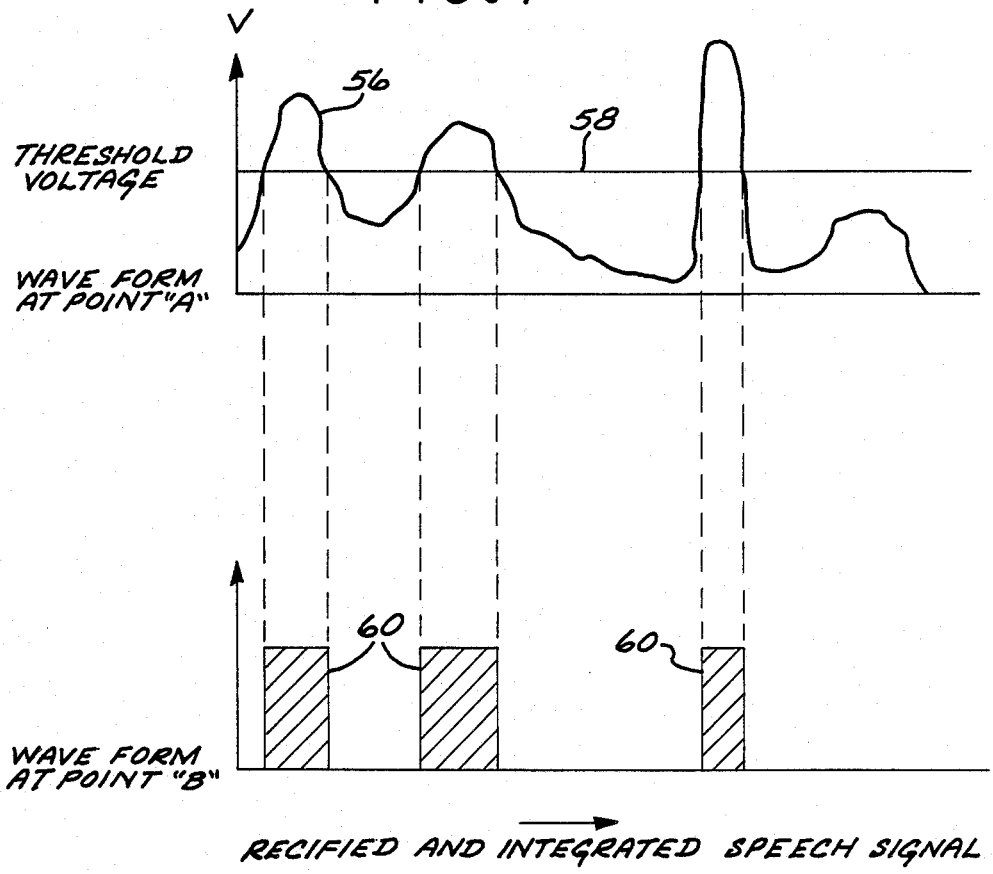
FIG. 4 is a diagram of the conversion scheme between the audio signal and the motor drive signal of the present invention.

FIG. 4 is a representation of the voltage appearing at various portions of the drive signal converter illustrated in FIG. 3. The top line of the first drawing in FIG. 4 illustrates the time-amplitude history of the audio signal seen at 46. Threshhold voltage 58 is set to determine when the audio signal will switch on the motor signal. Threshhold 58 can be set to actuate the motor more or less rapidly and/or more or less often, thereby controlling the response rate and amplitude of the motor. Thus, the threshhold setting is the determining factor for the timing and amplitudes of the digital signals 60 generated to drive the motor through the circuit 54.

Figure 5:
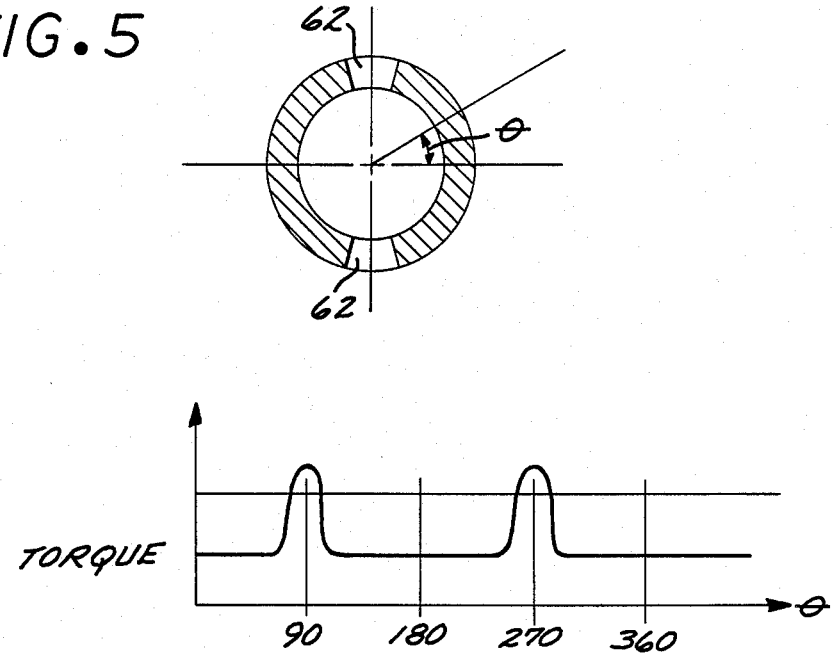
FIG. 5 is a cross-section of a conventional two pole motor and the damping torque seen at the shaft as a function of rotation.

A critical factor in the use of such signals to drive the motor and produce realistic facial movements is the construction of the motor 36. FIG. 5 is a cross-section of a conventional two pole motor illustrating the uneven torque that appears at the shaft 34 as the motor is driven by the shaft against the magnetic force of the stator 61 and rotor 63 when no signal is applied to the motor. This uneven torque is caused when poles 62 of the descrete magnets in the stator in the periphery of the motor come in close proximity to the metal poles 66 in the windings of the rotor located on the shaft.

Figure 6:
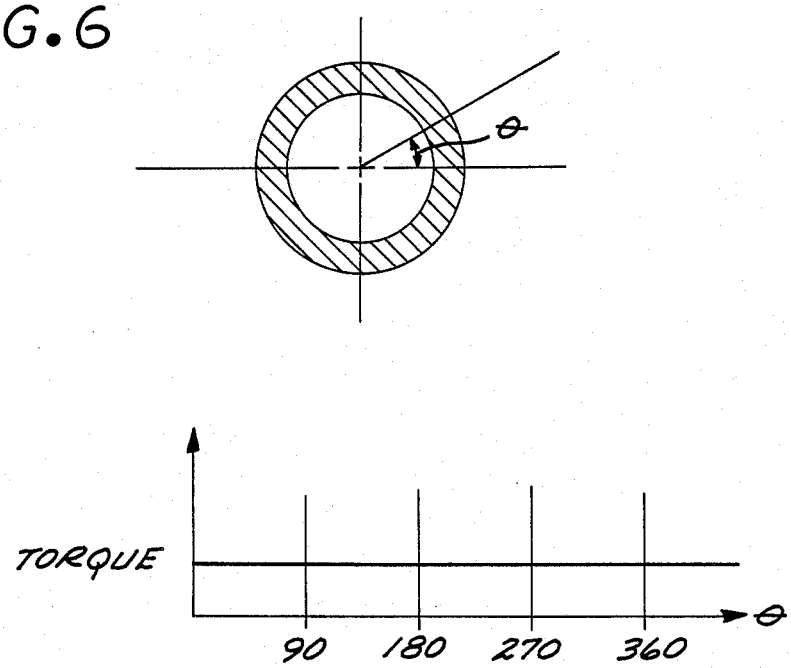
FIG. 6 is a cross-section of the constant air gap motor of the present invention and the torque as a function of shaft angle for the motor.

FIG. 6 illustrates a ring magnet with constant air gap motor of the type used in the present invention. While there are gaps 62 in the periphery of the magnet assembly, they are relatively small compared to the width of the rotor poles, and do not, therefore, result in major disturbances in the braking torque seen at the shaft as it is rotated. While this motor is particularly attractive for the invention, any motor which produces a relatively constant braking torque when rotated without a voltage being applied to the motor can be adapted for use in the invention. For example, certain pancake types of motors such as those used in camera drive mechanisms may be adapted to the present invention; however, at the present time the constant air gap motor presents a more economical choice. The lower drawing shows hhat the torque seen at the shaft 34 is essentially constant as a function of shaft angle, thereby providing constant damping appearing at the shaft of the motor of the present invention when the signal is removed from the motor as above in the "off" portion of the on-off drive signal as described.

Figure 7:
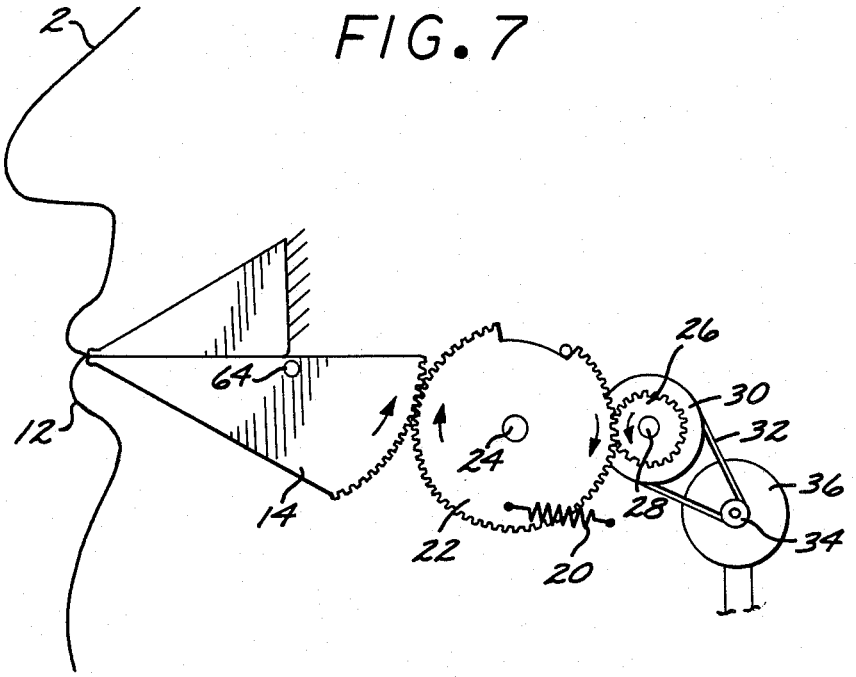
FIG. 7 is a cross-section of a mannequin employing the present invention whereby the upper jaw and lower jaw are operated with different amplitudes by the same drive mechanism.

FIG. 7 illustrates an embodiment of the present invention that provides for different excursions on various features in order to more accurately simulate speech. It is well known that the upper lip of humans, for example, moves far less during speech than the lower lip. The cross-section of FIG. 7 illustrates a lower lip 12 of mannequin 2 that is driven by structure 14 from gear 22 turning on shaft 24 and further driven by gear 26 on shaft 28 that is driven by pulley 30 and belt 32 from pulley 34 on motor 36. Spring 20 urges the lower lip mechanism pivoting on shaft 64 to its closed position. Pin stop 66 operating in slot 68 in gear 22 prevents undesirable movement of the lower lip 12 beyond limits defined by the linkage. In the mechanization, the upper lip is stationary in order to provide a simple but effective mechanization of the differential movement of the lips.

Figure 8:
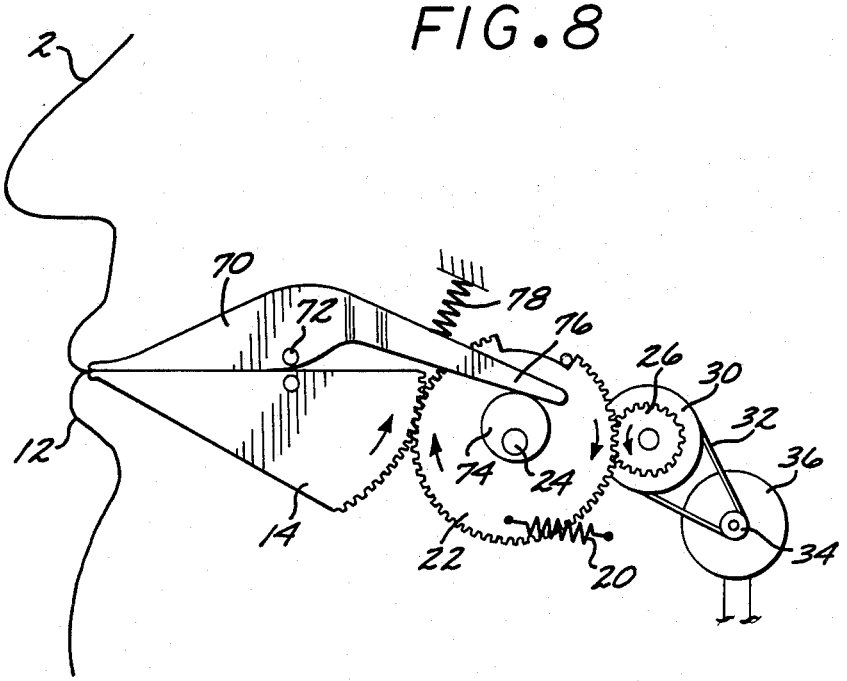
FIG. 8 is a cross-section of the drive mechanism similar to FIG. 7 showing the details of the upper jaw drive system.

FIG. 8 illustrates the mechanism for operating the upper lip 4 through structure 70 pivoting on pin 72 and moved by cam 74 mounted on gear 22 and operating lever 76 on structure 70. Spring 78 urges lever 76 into close proximity to cover 74, thereby assuring that structure 70 and lip 4 closely follow the motion produced by cam 74. This mechanism provides a more realistic representation of the differential movement of upper and lower lips in humans at some cost in mechanical complexity. While this may not be desirable in every case, the mechanism also illustrates, by way of example, methods of operating multiple features of different excursion and relative motion from the same basic drive mechanism.

Figure 9:
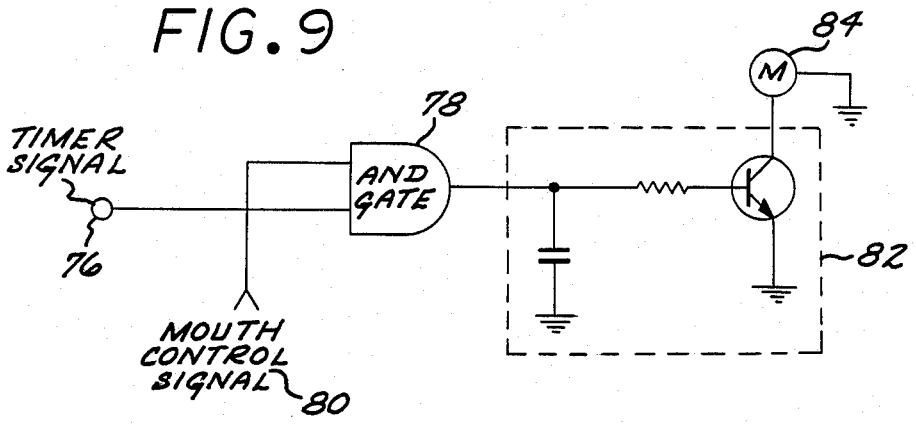
FIG. 9 is a schematic of the electronic drive mechanism for the drive signal to operate eye controls of the present invention.

It is often desirable to provide animations that are pleasing to the observer, but are not necessarily realistic representations of human or animal facial activity. FIG. 9 illustrates a circuit that provides a means of animating the eyes, either through light emitting diodes or motions of the eyes, which are pleasing to the observer. In practice, an audio signal appears at 76 and is directed to an end gate 78 along with the mouth control signal 80 that appears at point B of FIG. 3 and as described in the description of FIG. 4. When both the mouth control signal and the timer signal are present, the eye control signal is generated, representing the mouth control signal as gated by the timer pulse. This signal appears at amplifier 82 and is directed to the eye control mechanism 84. A mechanism similar to that used to control the mouth features as decribed above could also be used to control eye movement based upon this signal.

Figure 10:
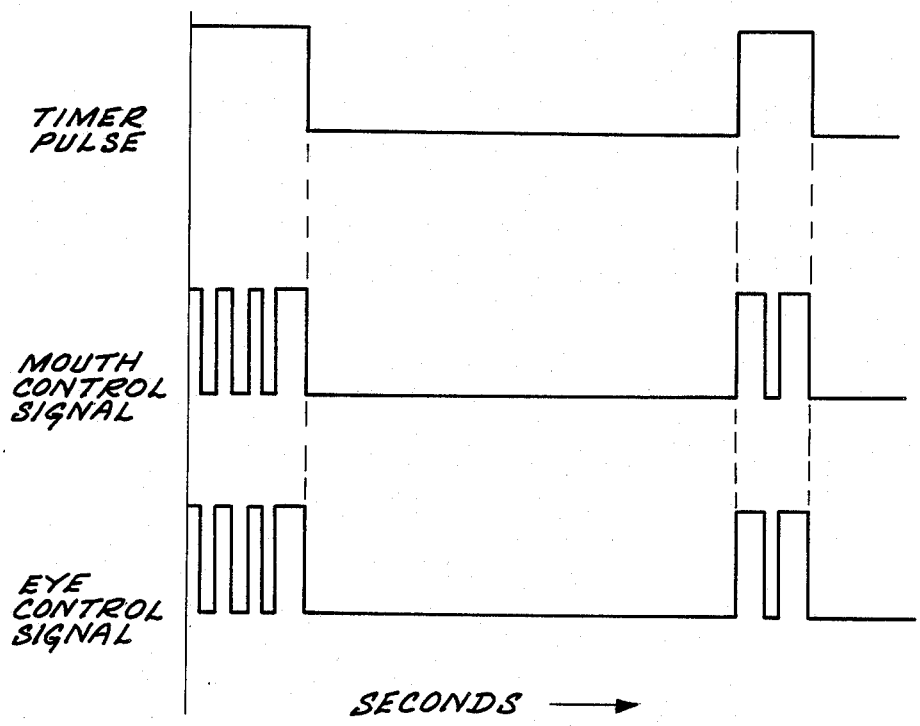
FIG. 10 is a diagram of the relationships between the timer pulse, the mouth control system and the eye control system controlled by the schematic shown in FIG. 9.

FIG. 10 illustrates the time sequence and nature of the eye control signal generated as a function of the feature control signal when gated by the timer pulse.

The timer pulse 86 can be in the form of an ultrasonic or subsonic signal on the audio signal or any one of a number of encoded signals designed to operate the gating circuit in combination with the electronic feature control signal. Thus the timer pulse 86 gates the mouth control signal 88, thereby passing on the motor control signal in its original form, at 90 with the signal that is ungated 92 not passing unless an on signal is present in timer pulse 86.

From the foregoing, it will be appreciated that the animation concept of the present invention provides for realistic animation of features such as the lips 4 and 12 of mannequin 2 by the use of a relatively simple, inexpensive and robust electromechanical mechanism and electronic drive system that can use the audio signals representative of normal speech without the necessity for complex electronic conversion or sophisticated servo mechanism.

While a particular form of the invention has been illustrated and described, it will also be apparent that various modifications can be made without departing from the spirit and scope of the invention. Consequently, it is not intended that the invention be limited except as by the appended claims.

I claim:

1. A talking doll with movable features which comprisies:

a mannequin, said mannequin incorporating at least one movable feature and an underlying structure;

a direct drive mechanism connected between said movable feature and said structure of said mannequin to produce relative motion of said feature and said mannequin;

said direct drive mechanism further comprising electromechanical means responsive to constant amplitude, variable duration electrical signals to move said movable features unidirectionally in opposition to the force exerted by deflection of an elastic means connected between said direct drive mechanism and said structure of said mannequin; and means to generate constant amplitude, variable duration electrical signals to be applied to said electromechanical means, said duration of said electrical signals derived from the amplitude of an audio signal supplied to said talking doll.

2. The talking doll of claim 1 wherein said electromechanical means in said direct drive mechanism comprises:

an electrical actuator displaying a constant braking force in the absence of an electrical input signal;

whereby said direct drive mechansim is driven by said electrical actuator in opposition to the force exerted by deflection of said elastic means.

3. The talking doll of claim 2 wherein said electrical actuator comprises an electric motor incorporating:

a shaft;

a rotor attached to said shaft said rotor incorporating a winding and at least two poles;

a stator incorporating a plurality of magnets; and a housing.

4. The talking doll of claim 3 wherein: said electric motor presents a constant braking torque at the shaft of said motor when said shaft is rotated in the absence of electric energization of said motor.

5. The talking doll of claim 3 wherein:

said electric motor incorporates a constant air gap between said rotor and said stator.

6. The talking doll of claim 5 wherein:

said electric motor incorporates a gap between the poles of the magnets of said stator that is relatively small compared to the width of the poles of said rotor.

7. The talking doll of claim wherein said linkage comprises:

a gear train between said actuator and said movable feature.

8. The talking doll of claim 2 wherein said elastic means comprises:

a spring.

9. The talking doll of claim 1 wherein said electronic means responsive to an audio signal to produce said electrical signal comprises:

an audio amplifier;

an integration means;

a threshholding means; and an amplification means;

the output of said amplification means operative to drive said mechanism.

10. The talking doll of claim 9 wherein the output of said audio amplifier is also used to actuate an audio speaker mounted in, or in close proximity to, said doll.

11. In a mannequin with at least one movable feature, the process of animation comprising the steps of:

creating an audio signal;

translating said audio signal into an electronic signal;

sensing the time deviation that said electronic signal exceeds a threshold;

creating a drive signal of constant amplitude corresponding to said time deviation;

driving a motor with essentially constant back torque with said drive signal, said motor actuating a linkage connecting said motor and a moveable feature; and opposing the movement of said linkage with an elastic means.

12. The process of animation of claim 11 wherein said linkage operates a plurality of features.

13. An animated figure which comprises:

at least one movable feature;

an underlying structure;

electromechanical means to move said feature relative to said structure, said electromechanical means further comprising;

means to generate an electronic signal representing an audio signal;

means to derive a constant amplitude, time variant drive signal from said electronic signal;

an electric motor driven in one direction only by said drive signal;

said motor actuating a linkage operating said feature relative to said structure; and elastic means opposing the driven motion of said motor.

14. The animated figure of claim 13 wherein said electric motor further comprises a motor which presents an essentially constant braking torque when the shaft of said motor is rotated in the absence of a drive signal.

15. The animated figure of claim 14 wherein said linkage incorporates a gear train between said motor and said movable feature.

16. The animated figure of claim 14 wherein said motor further comprises magnets in a stator and poles in a rotor, said magnets presenting a constant air gap between said stators and said rotor as it rotates and the gap between the poles of the magnets being relatively small compared to the width of the poles in said rotor.

17. The animated figure of claim 14 wherein said elastic means comprises:

a spring connected between said structure and said linkage.

* * * * *